US008070536B2

(12) United States Patent
Ono et al.

(10) Patent No.: US 8,070,536 B2
(45) Date of Patent: Dec. 6, 2011

(54) CRIMP TERMINAL, TERMINAL-PROVIDED WIRE, AND MANUFACTURING METHOD THEREOF

(75) Inventors: Junichi Ono, Yokkaichi (JP); Hiroki Hirai, Yokkaichi (JP); Tetsuji Tanaka, Yokkaichi (JP); Hiroki Shimoda, Yokkaichi (JP); Takuji Otsuka, Yokkaichi (JP); Shigeru Ogihara, Yokkaichi (JP); Akira Ito, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 57 days.

(21) Appl. No.: 12/734,336

(22) PCT Filed: Oct. 31, 2008

(86) PCT No.: PCT/JP2008/069844

§ 371 (c)(1),
(2), (4) Date: Apr. 26, 2010

(87) PCT Pub. No.: WO2009/057735

PCT Pub. Date: May 7, 2009

(65) Prior Publication Data

US 2010/0230160 A1 Sep. 16, 2010

(30) Foreign Application Priority Data

Nov. 2, 2007 (JP) ..... 2007-286680

(51) Int. Cl.
*H01R 4/10* (2006.01)

(52) U.S. Cl. ..... 439/877

(58) Field of Classification Search ..... 439/877, 439/878, 741, 775, 891
See application file for complete search history.

(56) References Cited

U.S. PATENT DOCUMENTS

| | | | | |
|---|---|---|---|---|
| 7,811,140 | B2 * | 10/2010 | Tabata et al. | 439/877 |
| 7,905,755 | B1 * | 3/2011 | Martauz | 439/877 |
| 2004/0157504 | A1 * | 8/2004 | Fujimoto et al. | 439/877 |

FOREIGN PATENT DOCUMENTS

| | | |
|---|---|---|
| JP | U 55-7235 | 1/1980 |
| JP | U 55-120080 | 8/1980 |
| JP | A 10-125362 | 5/1998 |

OTHER PUBLICATIONS

International Search Report issued in corresponding International Application No. PCT/JP2008/069844, mailed Jan. 20, 2009.

* cited by examiner

*Primary Examiner* — Khiem Nguyen
(74) *Attorney, Agent, or Firm* — Oliff & Berridge, PLC

(57) ABSTRACT

Provided is a technique of enabling high-compression crimping without breaking a crimp terminal while forming a recessed portion promoting a wire crimp portion of the crimp terminal to cut into a conductor in the wire crimp portion. The crimp terminal according to the invention includes a wire crimp portion, which is crimped to a conductor of a wire and includes a first crimp portion crimped to a base side of the conductor and a second crimp portion crimped to a tip end side. A recessed portion for promoting a cutting-in effect is formed in an inner surface of the wire crimp portion. A recessed portion formed in the second crimp portion is divided in a terminal width direction or is shallower than a recessed portion formed in the first crimp portion. Alternatively, the recessed portion is omitted and a recessed portion is formed only in the first crimp portion.

19 Claims, 19 Drawing Sheets

CRIMP TERMINAL, TERMINAL-PROVIDED WIRE, AND MANUFACTURING METHOD THEREOF

BACKGROUND OF THE INVENTION

1. Technical Field of the Invention

The present invention relates to a crimp terminal which is crimped to an end of a wire provided on an automobile or the like, a terminal-provided wire including the crimp terminal, and a manufacturing method thereof.

2. Description of the Related Art

To attach a terminal to an end of an insulated wire, there is conventionally often used a crimping technique. The crimping is performed by caulking a conductor barrel formed in advance on the terminal onto the end of a conductor of the insulated wire by use of a die.

This crimping technique, however, involves a difficulty of setting a crimp height of the conductor barrel. A low crimp height has a merit of lowering contact resistance between the conductor barrel and the conductor because the compression ratio of the conductor (a ratio between a sectional area of the conductor before crimping and that after crimping) is lowered, or in other words, crimping is performed with a high compression of the conductor, while causing a demerit of decreasing mechanical strength, in particular tensile strength against an impact load (more specifically, the holding strength by which the crimp terminal holds the wire), because of a high reduction rate of the conductor sectional area. On contrary, a high crimp height has a merit of maintaining high mechanical strength by securing a high compression ratio, that is, by suppressing a degree of the conductor compression, while raising the contact resistance between the conductor barrel and the conductor of the wire.

For solving the problem, as disclosed in Patent Document 1, for example, there is well known a conventional technique for increasing the strength with which the terminal holds the wire and effectively lowering the contact resistance: the technique includes forming a serration of a plurality of recessed grooves arranged in a parallel direction to an axial direction on an inner surface of a wire crimp portion of the crimp terminal, which surface is caulked to the conductor on the end of the wire. The serration increases a contact area between the wire crimp portion of the crimp terminal and the conductor. Furthermore, edges of the serration, particularly edges extending orthogonally to a terminal axis direction, cut into the conductor, thereby increasing the holding strength of the conductor by the wire crimp portion and lowering the contact resistance.

This technique of forming recessed grooves, however, has the other following problems.

Depending on the type of the wire onto which the crimp terminal is crimped, it may be required to set the compression ratio of the conductor due to crimping low to more highly compress the conductor. For example, in the case of the conductor formed of aluminum or aluminum alloy, on the surface of which an oxide film that will be a factor of deteriorating contact resistance tends to be formed, there is required to perform a high compression by setting the crimp height considerably lower than the case of the conductor formed by, for example, copper or copper alloy, in order to lower the contact resistance sufficiently against the oxide film.

Thus crimping with a high compression involves marked plastic deformation of the terminal crimp portion in the crimp terminal (in particular, axial stretch and thickness reduction). Accordingly, crimping the terminal crimp portion forming the recessed grooves described above may involves breaking the part forming the recessed grooves, that is, the part having a locally small thickness. This means that forming a recessed portion such as a serration in the terminal crimp portion will be extremely limited to a minimum of the compression ratio of the crimping, that is, a delimitation of the high compression. Patent Document 1: Japanese Patent Application Publication No. H10-125362

SUMMARY OF THE INVENTION

It is therefore an object of the present invention to provide a technique enabling high-compression crimping without involving a breakage of a crimp terminal while forming a wire crimp portion of the crimp terminal with a recessed portion for promoting the wire crimp portion to cut into a conductor. To achieve this object, the present invention provides a crimp terminal having an electric connection portion which is fitted to a counterpart terminal to thereby make electrical connection, and a wire crimp portion which is crimped to an end of a wire in which a conductor is exposed in the end. The wire crimp portion of the crimp terminal includes a first crimp portion which is crimped onto the conductor on the end of the wire from an outer side, and a second crimp portion which is crimped onto the conductor with a higher degree of compression than the first crimp portion, from the outer side, in a position closer to a tip of the conductor than that of the first crimp portion, further satisfying at least one of the following conditions A to C.

A. Recessed portions forming edges which cut into the conductor are provided to an inner surface of the first crimp portion and an inner surface of the second crimp portion respectively, wherein the recessed portion provided in the first crimp portion is continuous in a direction orthogonal to an axial direction of the terminal, while the recessed portion provided in the second crimp portion is divided into a plurality of recessed portions in a division direction orthogonal to the axial direction of the terminal and the divided recessed portions are separated from each other in the division direction.

B. Recessed portions forming edges which cut into the conductor are provided to an inner surface of the first crimp portion and an inner surface of the second crimp portion respectively, wherein a maximum depth of the recessed portion provided in the second crimp portion is smaller than a maximum depth of the recessed portion provided in the first crimp portion.

C. A recessed portion forming an edge which cuts into the conductor is provided only on an inner surface of the first crimp portion of the first and second crimp portions.

The present invention further provides a terminal-provided wire comprising a wire having an end in which a conductor is exposed and a crimp terminal crimped to the end, wherein the wire crimp portion of the crimp terminal is crimped onto the conductor on the end of the wire from an outer side, and the second crimp portion is crimped onto the conductor with a higher degree of compression than the first crimp portion formed with the recessed portion.

The present invention further provides a method of manufacturing a terminal-provided wire including a wire having an end in which a conductor is exposed and a crimp terminal crimped to the end, the method including: a terminal forming step of forming the crimp terminal from a metal plate; and a crimping step of crimping the wire crimp portion of the crimp terminal onto the conductor in the end of the wire from the outer side so as to crimp the second crimp portion of the wire crimp portion onto the conductor with a higher degree of compression than the first crimp portion.

According to the present invention, in the wire crimp portion of the crimp terminal, the first crimp portion, which is crimped onto the conductor with a suppressed degree of compression, is formed with a recessed portion effective in promoting a cutting-in effect into the conductor, the suppressed compression and the cutting-in promotion effect of the recessed portion maintaining a high holding strength of the conductor. Meanwhile, in the second crimp portion which is crimped onto the conductor with a higher degree of compression than the first crimp portion, a) the division of the recessed portion in an orthogonal direction to the terminal axis direction, or b) the maximum depth of the recessed portion smaller than that of the recessed portion of the first crimp portion, or c) forming no recessed portion in the second crimp portion, enables the second crimp portion to be crimped onto the tip end side part of the conductor with the high degree of compression while avoiding terminal breakage due to formation of the recessed portion.

Description of the Preferred Embodiments

Preferred embodiments of the present invention will be described below with reference to the drawings.

Figure 1:
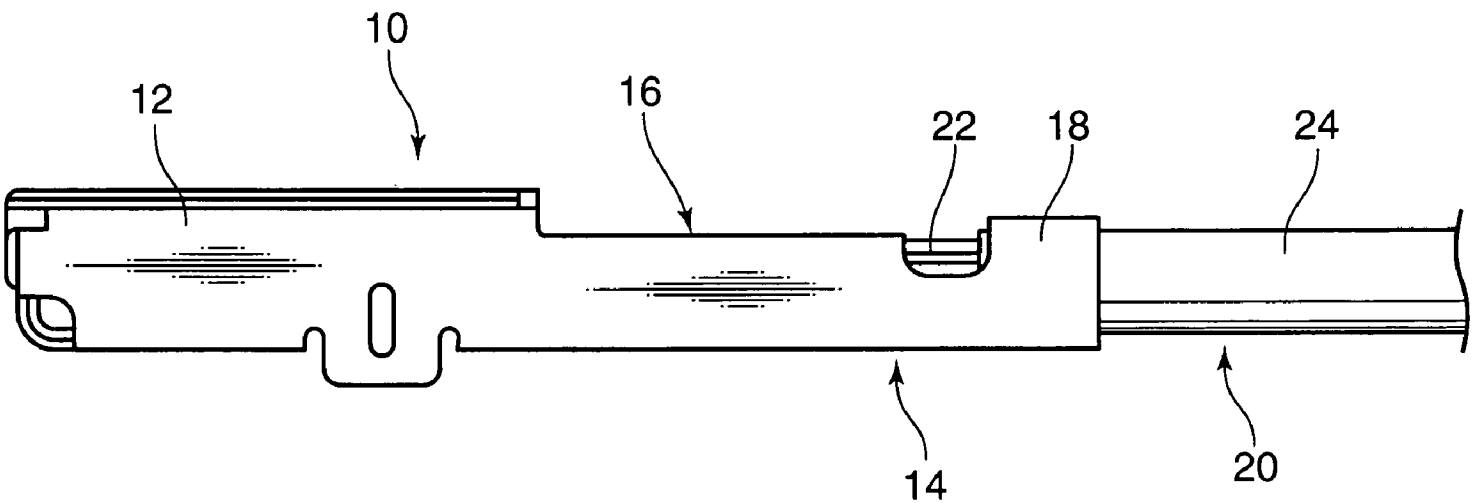
FIG. 1 is a side view of a terminal-provided wire according to a first embodiment of the present invention.

FIG. 1 shows a terminal-provided wire manufactured according to a first embodiment of the present invention. This terminal-provided wire includes a wire 20 and a crimp terminal 10. The wire 20 is formed of a conductor 22 and an insulating covering 24 covering the conductor 22 from a radial outer side. There is removed a part of the insulation covering 24 in an end of the wire 20 to partially expose the conductor 22. Onto this end of the wire 20, the crimp terminal 10 is crimped.

The conductor 22 is not limited to its material: various materials in addition to typically employed copper and copper alloy are permitted to be used. However, the present invention is particularly effective in the case of the conductor formed from a material, such as aluminum or aluminum alloy, whose surface tends to be formed with an oxide film causing a requirement of a high degree of compression during the crimping.

The terminal-provided wire is manufactured through the following terminal forming process and crimping process.

1) Terminal Forming Process

Figure 2:
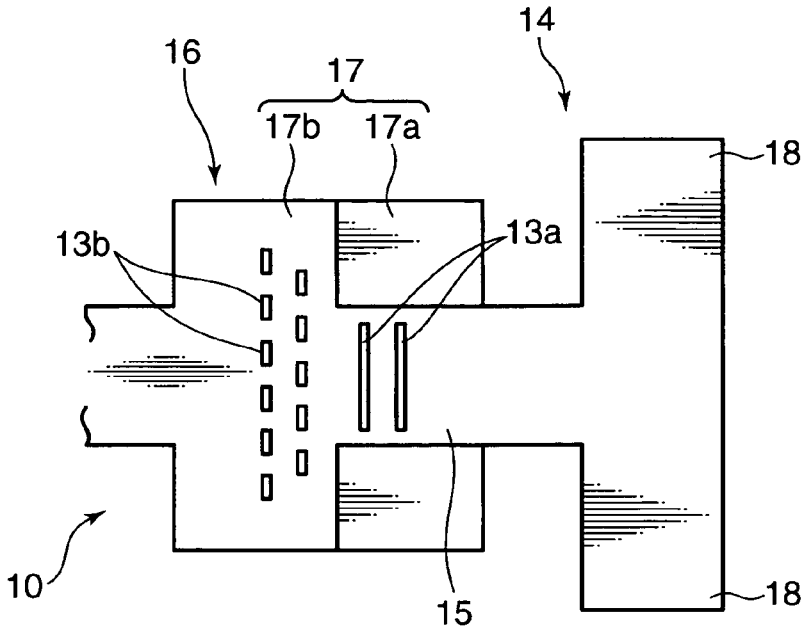
FIG. 2 is an envelopment of a crimp terminal according to the first embodiment of the present invention.
Figure 3:
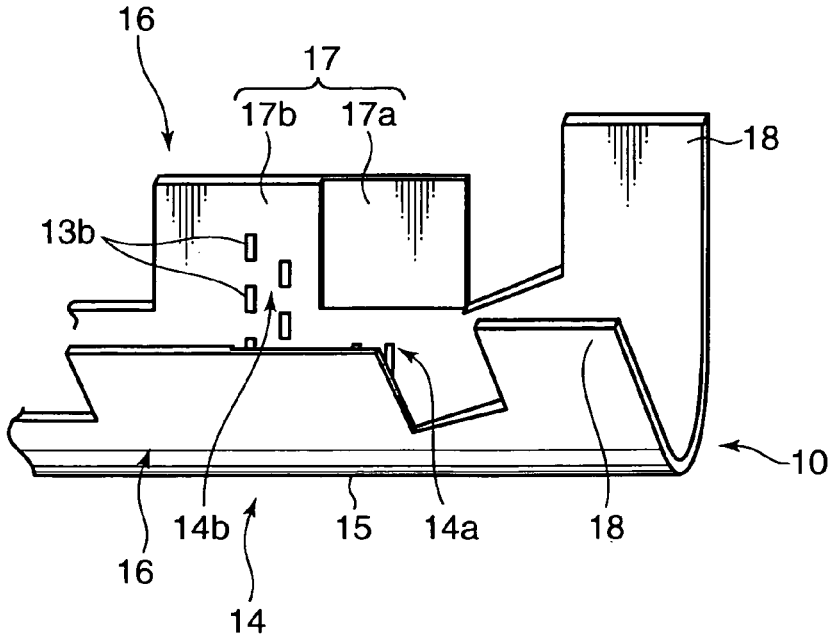
FIG. 3 is a perspective view showing a shape of the crimp terminal in FIG. 2 following forming.

In this process, formed is such a crimp terminal 10 as shown in FIGS. 2 and 3, that is , the crimp terminal 10 in the state before being crimped to the end of the wire. The forming is performed, similarly to a normal terminal, through a process of punching out a terminal original plate, such as that shown in FIG. 2, from a metal plate and bending the terminal original plate.

Similarly to a conventional terminal, the crimp terminal 10 has an electric contact portion 12 and a wire crimp portion 14 at the front and rear, respectively. In this embodiment, the electric contact portion 12 is a female type, formed into a box shape into which a male terminal, not shown in the drawings, can be fitted. The wire crimp portion 14 includes a basal portion 15 extending rearward in an axial direction from the electric contact portion 12, a right-left pair of conductor barrels 16 extending across the axial direction (orthogonally to the axial direction in the drawings) from the basal portion 15, and a right-left pair of insulation barrels 18 extending substantially parallel to the respective conductor barrels 16. Each of the conductor barrels 16 takes a U-shaped front form, as shown in FIG. 3, and the insulation barrels 18 take similar forms.

Each conductor barrel 16 includes an inner surface 17 which is brought into close contact with the conductor 22 of the wire 20 by the bending thereof. The inner surface 17, including a surface (to be referred to hereafter as a "first inner surface") 17*a* which closely contacts a base side part of the conductor and a surface (to be referred to hereafter as a "second inner surface") 17*b* which closely contacts a tip end side part of the conductor 22, has such a shape that the second inner surface 17*b* inwardly projects beyond the first inner surface 17*a* to perform, by the bending, a higher compression of the tip end side part of the conductor than the compression of the base side part of the conductor.

The conductor barrel 16 according to this embodiment is press-formed into such a shape that the first inner surface 17*a* is recessed deeply beyond the second inner surface 17*b*. The forming may be performed at the same time as the terminal original plate of the crimp terminal 10 is punched out of the aforementioned metal plate, or after the punching and before the bending process for raising the conductor barrel 16 from the basal portion 15.

On contrast, the conductor barrel 16 in this embodiment has an outside surface having a uniform height, including no step. Hence, in the conductor barrel 16 according to this embodiment, the part which is crimped to the tip end side part of the conductor 22 is thicker than the part which is crimped to the base side part.

The wire crimp portion 14 includes a first crimp portion 14*a* having a surface formed with a plurality of first recessed portions 13*a* in a region where the wire crimp portion 14 is crimped onto the base side part of the conductor 22 and a second crimp portion 14*b* having a surface formed with a plurality of second recessed portions 13*b* in a region where the wire crimp portion 14 is crimped onto the tip end side part of the conductor 22. Each of the recessed portions 13*a* and 13*b* has front and rear edges each extending in a terminal width direction. The edges cut into the conductor 22 to increase the holding strength by which the crimp terminal 10 holds the conductor 22, and further break through the oxide film formed on the surface of the conductor 22 to promote lowering contact resistance.

The first recessed portions 13*a* are formed in a region of the basal portion 15 which region is sandwiched between the right and left first inner surfaces 17*a*. The first recessed portions 13*a* are narrow grooves extending continuously in a direction orthogonal to the terminal axial direction, i.e., the terminal width direction, arranged parallel to each other in the axial direction of the terminal.

The second recessed portions 13*b* are arranged in a region across the right and left second inner surfaces 17*b* and an inner surface of the basal portion 15 which surface is sandwiched between the second inner surfaces 17*b*. The second recessed portions 13*b* are formed as small rectangular shapes, arranged in two rows to the front and rear. Each row includes the second recessed portions 13*b* spaced in the terminal width direction, the positions of the second recessed portions 13*b* in the front row and that in the rear row being offset from each other in the terminal width direction. In short, the second recessed portions 13*b* are arranged in a zigzag pattern.

This arrangement is to avoid the breakage of the crimp terminal 10 during the crimp of the first crimp portion 14*a*. The part formed with the recessed portions has a locally decreased thickness, thus easily broken particularly therein: the dispersion of the recessed portions in the terminal width direction prevents the crimp terminal 10 from being broken to be axially divided.

The maximum depth of the first recessed portion 13*a* may be equal to or greater than a maximum depth of the second recessed portion 13*b*.

2) Crimping Process

Figure 4:
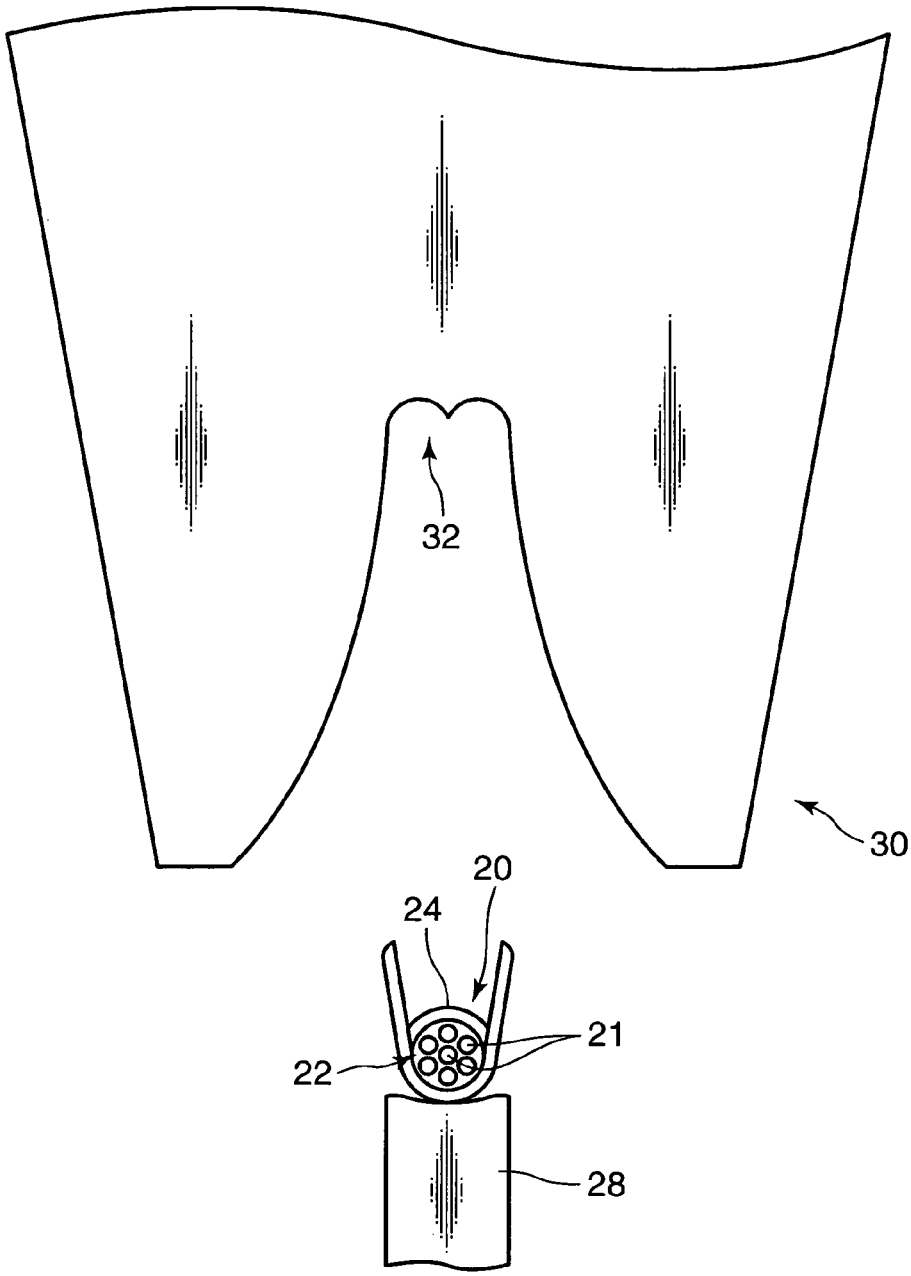
FIG. 4 is a front view showing a crimping process for manufacturing the terminal-provided wire.
Figure 5:
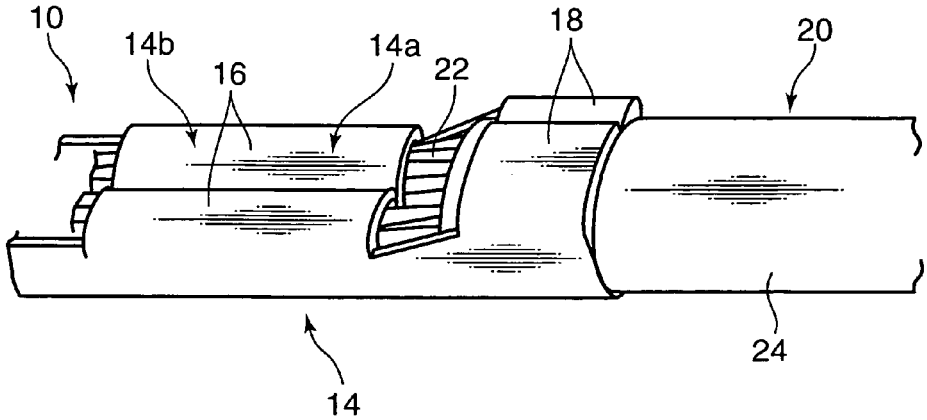
FIG. 5 is a perspective view showing a crimped part of the terminal-provided wire.

In this process , the end of the wire 20 is set on the basal portion 15 of the wire crimp portion 14; in this state, the conductor barrel 16 and the insulation barrel 18 are caulked by a normal die table 28 and a normal die 30 as shown in FIG. 4, thereby making the wire crimp portion 14 including the respective barrels 16 and 18 be crimped to the conductor 22 on the end of the wire 20 and the insulation covering 24 directly to the rear thereof . More specifically, the crimp terminal 10 and the end of the wire 20 are placed on the die table 28, and the die 30 having a pressing surface 32 corresponding to the post-crimping shape is lowered thereon, thus the barrels 16 and 18 being bent so as to hold the conductor 22 and the insulation covering 24 respectively.

Figure 6:
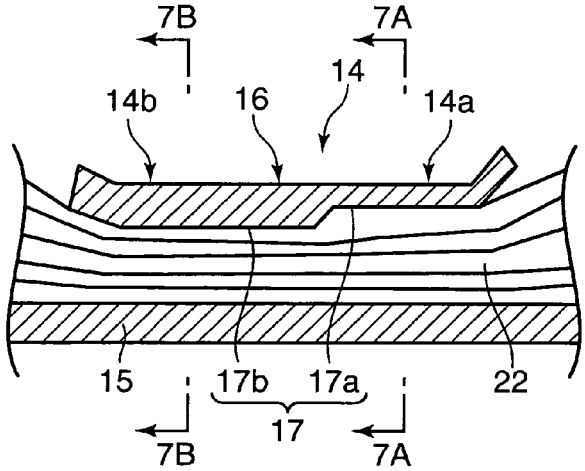
FIG. 6 is a sectional side view of the crimped part.
Figure 7A:
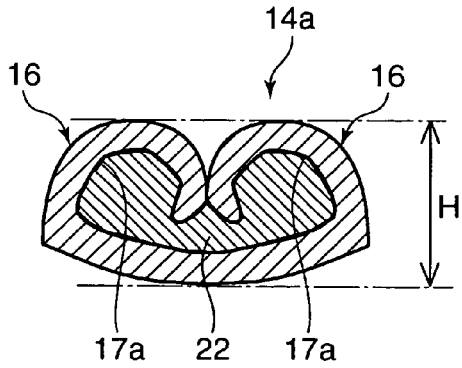
FIG. 7A is a sectional view taken along a 7A-7A line in FIG. 6.
Figure 7B:
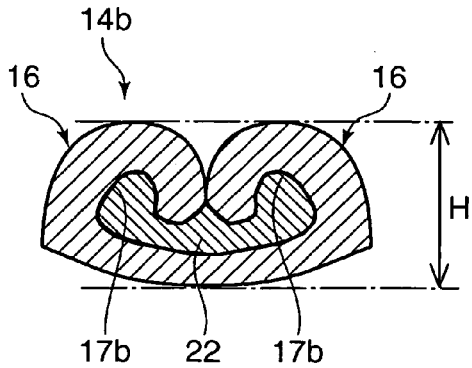
FIG. 7B is a sectional view taken along a 7B-7B line in FIG. 6.

Followed by this, the inner surface 17 of the conductor barrel 16 is formed such that the second inner surface (the inner surface on the conductor tip end side) 17*b* thereof inwardly projects beyond the first inner surface (the inner surface on the conductor base side) 17*a*; this allows the second inner surface 17*b* to perform a higher compression of the conductor 22, as shown in FIGS. 6 and 7, even when the conductor barrel 16 is crimped to the conductor 22, similarly to normal crimping, at a uniform crimp height H over the entire axial direction region as shown in FIGS. 7A and 7B, for example. In other words, a compression ratio on this part (on the tip end side part) is lowered than that (of the base side part) of the conductor 22 given by the first inner surface 17*a*. Such a crimping on the tip end side part of the conductor 22 with the higher compression effectively lowers contact resistance between the conductor 22 and the conductor barrel 16, while suppressing compression in the base side part of the conductor 22 enables high tensile strength of the terminal-provided wire, or more specifically the strength with which the conductor barrel 16 holds the conductor 22, to be ensured. This means the establishment of both of lowering the contact resistance and ensuring the sufficient mechanical strength.

Furthermore, the first recessed portions 13*a* formed on the inner surface of the first crimp portion 14*a* which is crimped with a relatively low compressive force are continuous in the terminal width direction, whereas the second recessed portions 13*b* formed on the inner surface of the second crimp portion 14*b* which is crimped with a high degree of compression are divided in the terminal width direction to be separated from each other in the direction; this allows the first recessed portions 13*a* in the first crimp portion 14*a* to generate a sufficient cutting-in effect, while avoiding breakage in the second crimp portion 14*b* due to crimping with a high compression (low compression ratio).

Specifically, the first recessed portions 13*a* formed in the first crimp portion 14*a*, being continuous in the terminal width direction, can form unidirectional edges in the same direction, exhibiting a sufficient cutting-in effect over the entire continuous region of the terminal width direction. Moreover, the suppressed compression on the first crimp portion 14*a*, even though the first recessed portions 13*a* is continuous in the terminal width direction, allows the breakage of the terminal in the locations where the first recessed portions 13*a* are formed to be avoided.

On the other hand, since the second recessed portions 13*b* formed in the second crimp portion 14*b* are arranged intermittently in the terminal axis direction (i.e. dispersed in a single direction), the crimp terminal 10 is unlikely to break even when the second crimp portion 14*a* is crimped with a high degree of compression. For example, the conductor 22 formed of aluminum or aluminum alloy may require a low compression ratio of approximately 40% to 70% for the second crimp portion 14*b* to break through an oxide film formed on the surface thereof to lower the contact resistance: even in this case, the breakage of the second crimp portion 14*b* can be avoided.

Furthermore, the arrangement of the plurality of second recessed portions 13*b* in a plurality of rows in the terminal axis direction in the second crimp portion 14*b* and the offset of each of the recessed portions in each of the rows from the recessed portions provided in the adjacent row in the row direction (i.e. the zigzag arrangement) allows the cutting-in effect to be uniform in the terminal width direction, despite of the intermittent arrangement of the second recessed portions 13*b* in the terminal width direction.

Figure 8:
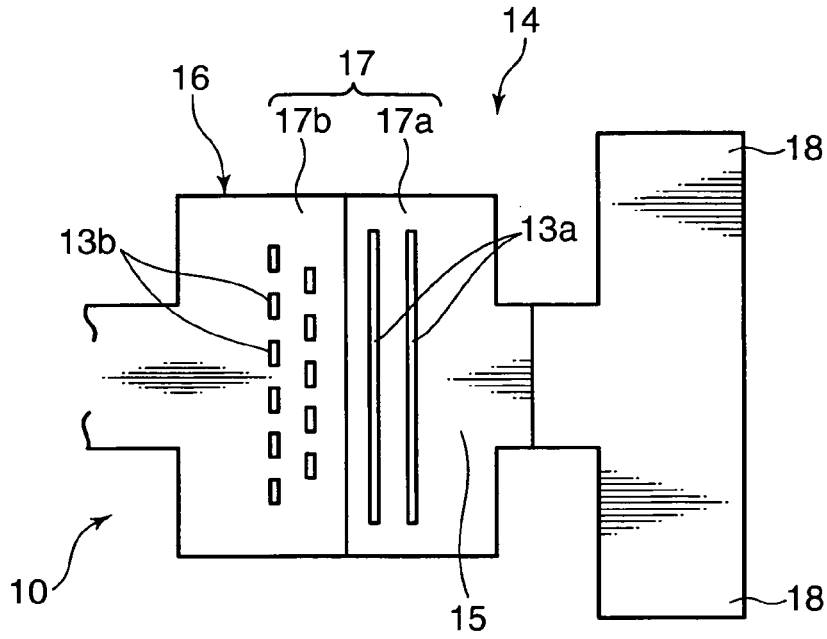
FIG. 8 is an envelopment of a crimp terminal according to a second embodiment of the present invention.
Figure 9:
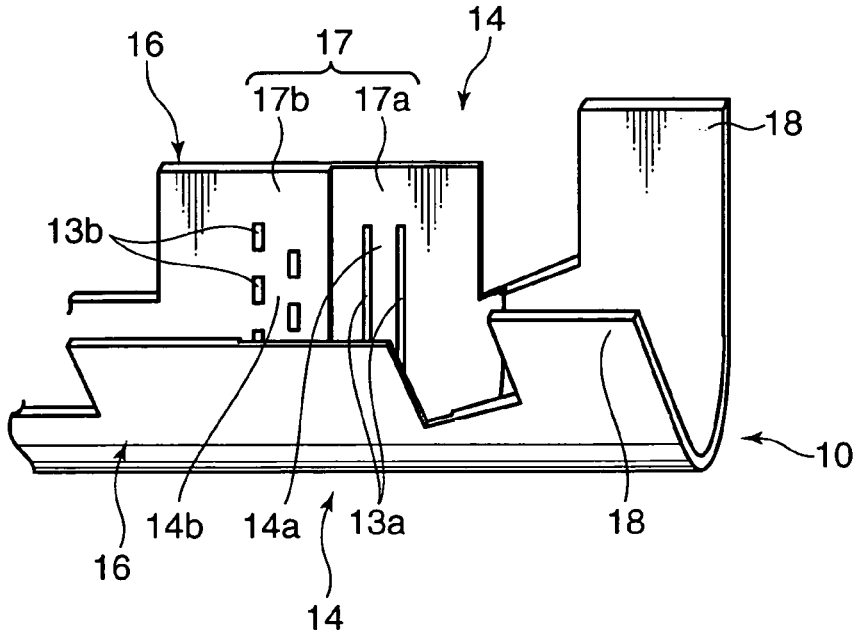
FIG. 9 is a perspective view showing a shape of the crimp terminal in FIG. 8 following forming.

The height difference between the inner surfaces of the wire crimp portion 14 may be applied not only to the inner surface of the basal portion 15 but also the inner surface of the conductor barrel 16. For example, as a second embodiment shown in FIGS. 8 and 9, the inner surface of the basal portion 15 sandwiched between the two first inner surfaces 17*a* may be recessed similarly to the first inner surfaces 17*a*. In this case, as shown in the drawings, the first recessed portions 13*a* may be formed continuously in a region across the inner surface of the basal portion 15 and the first inner surfaces 17*a* on either side thereof.

Figure 10:
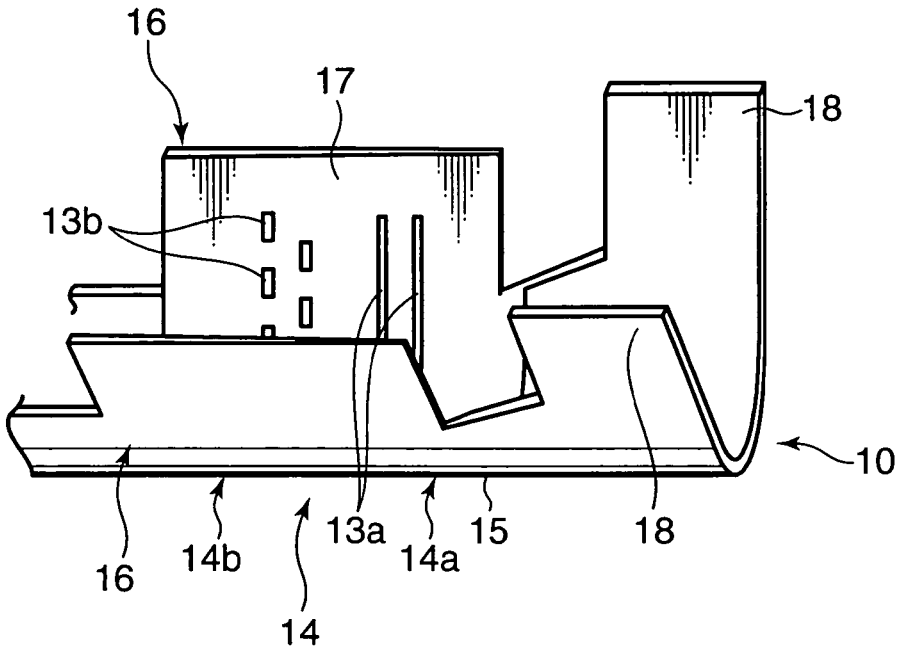
FIG. 10 is a perspective view showing a shape of a crimp terminal according to a third embodiment of the present invention following forming.
Figure 11:
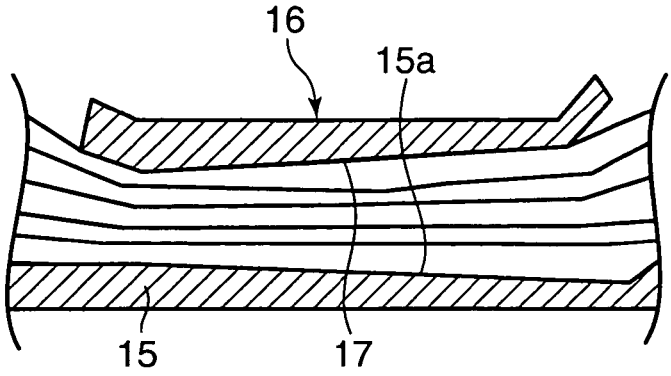
FIG. 11 is a sectional side view of a crimped part of the crimp terminal.

The inner surface of the conductor barrel according to the present invention do not absolutely requires a step as described above; for example, as a third embodiment shown in FIGS. 10 and 11, the inner surface 17 of the crimp terminal 10 may be a tapered surface , an inward projection amount of which gradually increases with closing to the tip end side part of the conductor 22. Also such a shape of the inner surface 17 can provide a difference in compression ratio between the tip end side part and the base side part of the conductor 22, and further vary the compression ratio of the conductor 22 smoothly in the axial direction. This case preferably includes that the second recessed portions 13*b* be formed in a specific part on the tip end side (in the second crimp portion 14*b*) and the first recessed portions 13*a* be formed in a specific part on the base side (in the first crimp portion 14*a*).

The first inner surface 17*a* and second inner surface 17*b* having the above-mentioned difference can be also formed, for example, by inwardly folding back an appropriate peripheral edge part of the metal plate constituting the conductor barrel 16. This forming enables the effects described above to be generated without thinning the conductor barrel 16 but, on the contrary, with thickening it to strengthen it.

Figure 12:
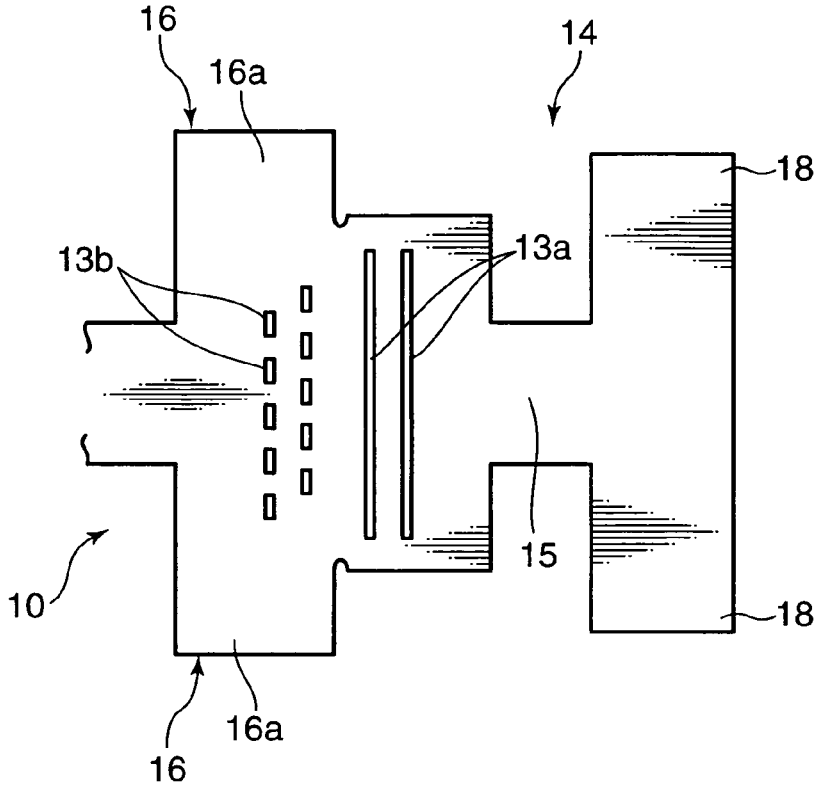
FIG. 12 is an envelopment of a crimp terminal according to a fourth embodiment of the present invention.
Figure 13:
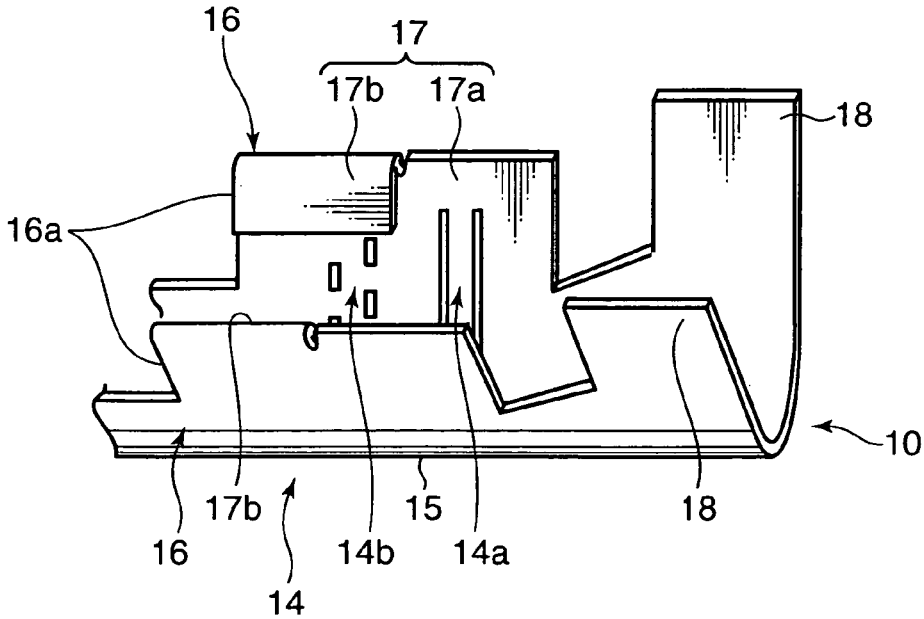
FIG. 13 is a perspective view showing a shape of the crimp terminal in FIG. 12 following forming.
Figure 14:
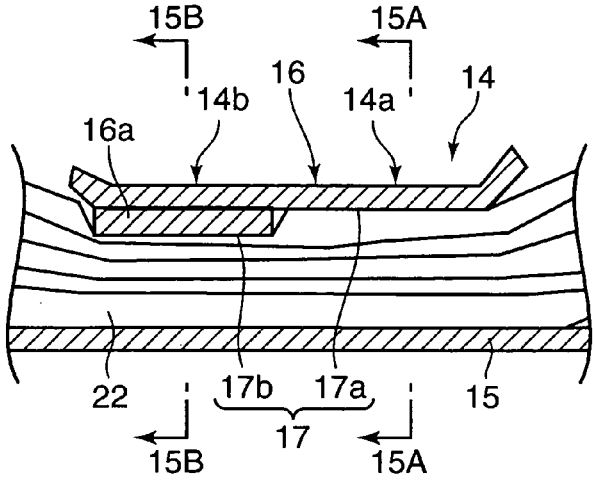
FIG. 14 is a sectional side view of a crimped part of the crimp terminal shown in FIG. 13.
Figure 15A:
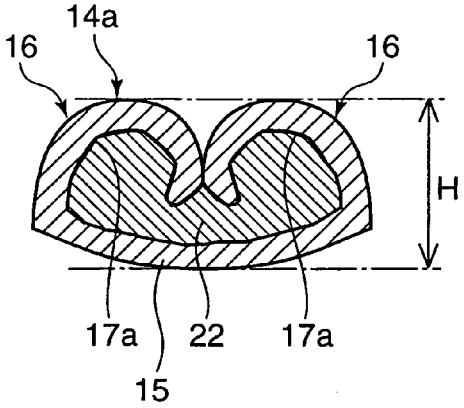
FIG. 15A is a sectional view taken along a 15A-15A line in FIG. 14.
Figure 15B:
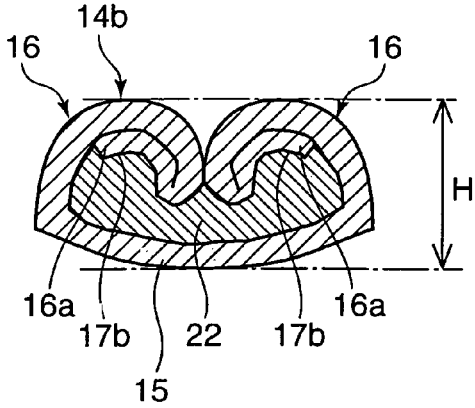
FIG. 15B is a sectional view taken along a 15B-15B line in FIG. 14.

For example, the crimp terminal 10 shown in FIGS. 12 to 15 as to a fourth embodiment is formed with an extended end portion 16*a* in the metal plate constituting the conductor barrel 16 as shown in FIG. 12, the extended end portion 16*a* extending from only a front side part of a barrel main body part (the part which is crimped to the tip end side part of the conductor 22) in a direction where the conductor barrel 16 extends and being folded back to the basal portion 15 side. As a result, a front side surface of the thus folded-back extended end portion 16*a* has formed the second inner surface 17*b* of the conductor barrel 16, as shown in FIGS. 13 and 14.

The second inner surface 17*b* is inwardly positioned beyond the first inner surface 17*a* which is the inner surface of the conductor barrel 16 located to the rear of the extended end portion 16*a*, by the thickness of the extended end portion 16*a*. Hence, similarly to the first embodiment, upon the crimp of the conductor barrel 16 onto the conductor 22, the second inner surface 17*b* is crimped onto the tip end side part of the conductor 22 at a lower compression ratio than the compression ratio at which the first inner surface 17*a* compresses the base side part of the conductor 22, that is, with a higher degree of compression.

Figure 16:
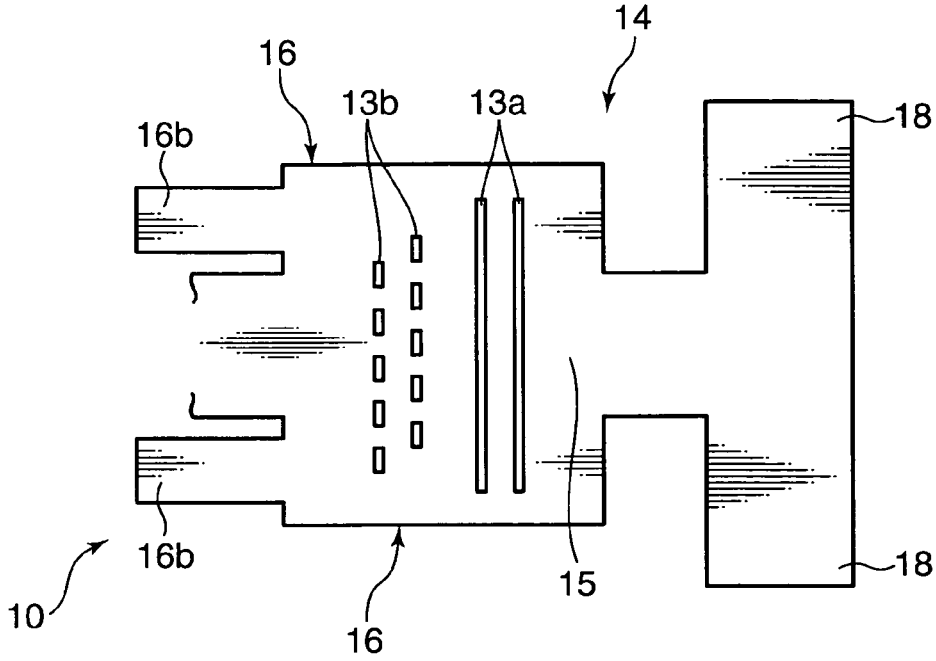
FIG. 16 is an envelopment of a crimp terminal according to a fifth embodiment of the present invention.
Figure 17:
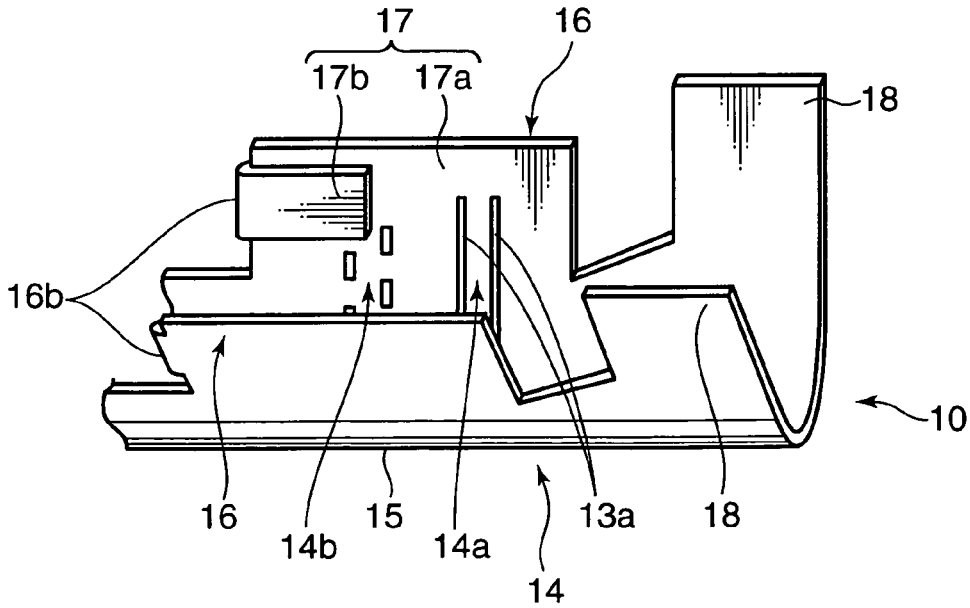
FIG. 17 is a perspective view showing a shape of the crimp terminal in FIG. 16 following forming.
Figure 18:
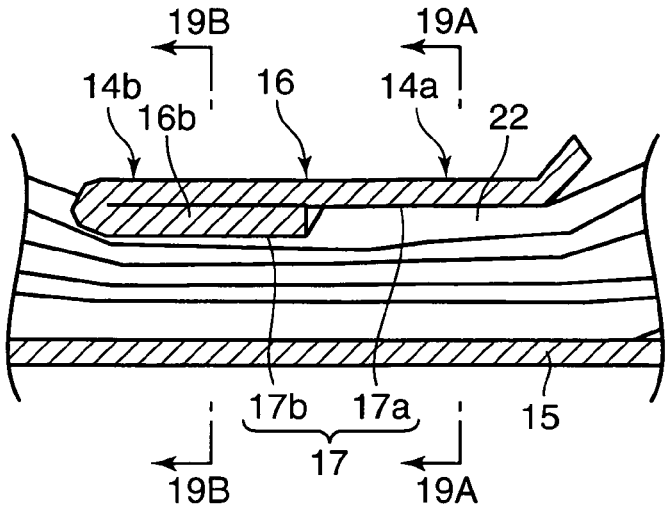
FIG. 18 is a sectional side view of a crimped part of the crimp terminal shown in FIG. 17.
Figure 19A:
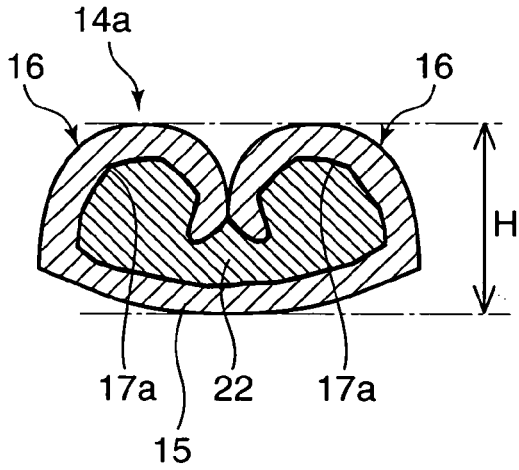
FIG. 19A is a sectional view taken along a 19A-19A line in FIG. 18.
Figure 19B:
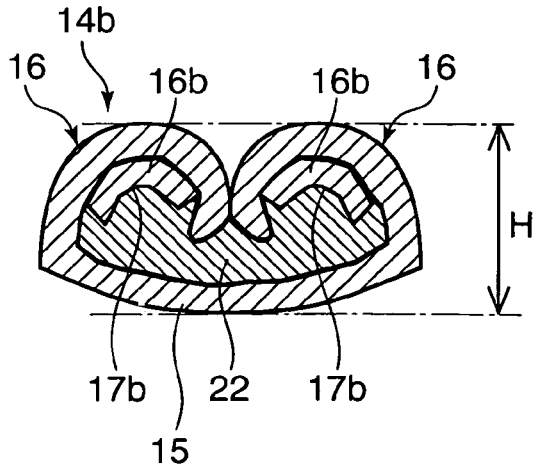
FIG. 19B is a sectional view taken along a 19B-19B line in FIG. 18.

The crimp terminal 10 shown in FIGS. 16 to 19 as to a fifth embodiment includes an extended portion 16*b*, which is formed in the metal plate constituting the conductor barrel 16 as shown in FIG. 16 and extends forward (toward the tip end side of the conductor 22) from the barrel main body part in the terminal axis direction, the extended portion 16*b* being folded back inwardly and rearwardly. As a result, a front side surface of the thus folded-back extended portion 16*b* has formed the second inner surface 17*b* of the conductor barrel 16 as shown in FIGS. 17 and 18.

All of ones described above can provide a difference in compression ratio between the tip end side part and base side part of the conductor in a simple structure.

Figure 20:
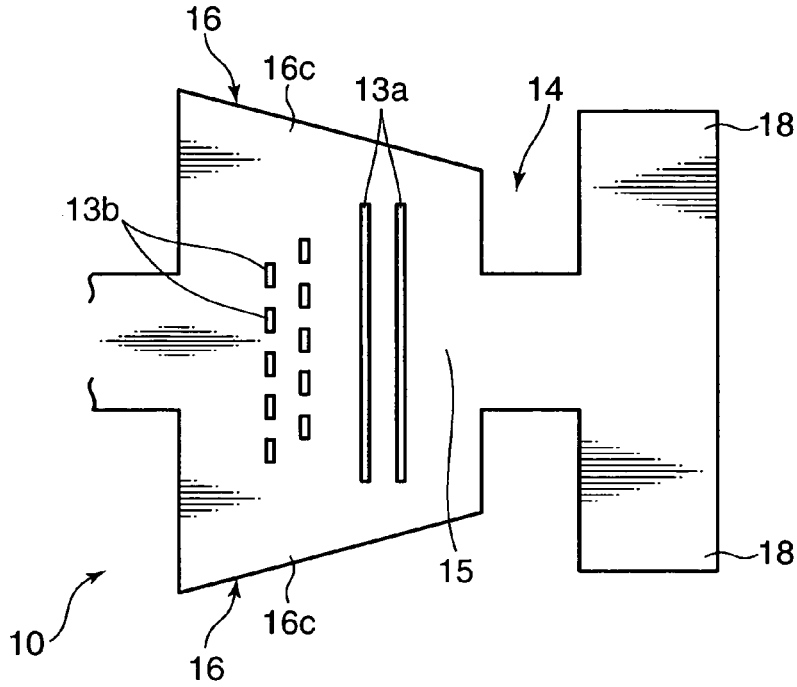
FIG. 20 is an envelopment of a crimp terminal according to a sixth embodiment of the present invention.
Figure 21:
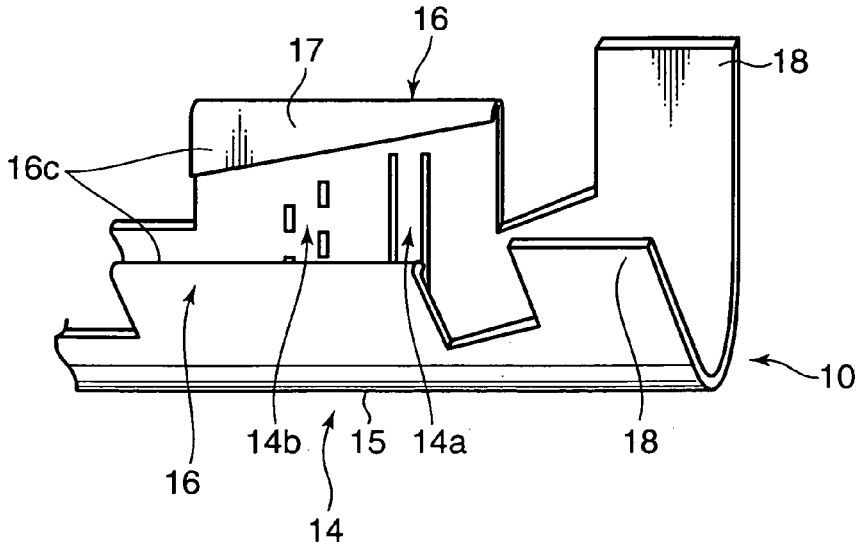
FIG. 21 is a perspective view showing a shape of the crimp terminal in FIG. 20 following forming.

The folded-back part may be an outside edge portion 16*c* of the conductor barrel 16 shaped as shown in FIGS. 20 to 22 as to a sixth embodiment . The outside edge portion 16*c* has a shape of widening with close to a terminal front side (the tip end side of the conductor 22) from a terminal rear side (the base side of the conductor 22), that is, such a shape that the outside edge portion 16*c* in the state of having been folded back inwardly toward the basal portion 15 as shown in FIG. 21 has a folded-back dimension which increases with closing to the tip end side of the conductor.

Figure 22A:
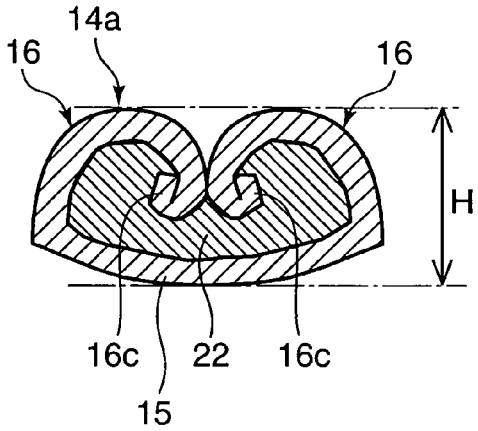
FIG. 22A is a sectional front view of a part of the crimp terminal shown in FIG. 13 which is crimped to a base side part of a conductor.
Figure 22B:
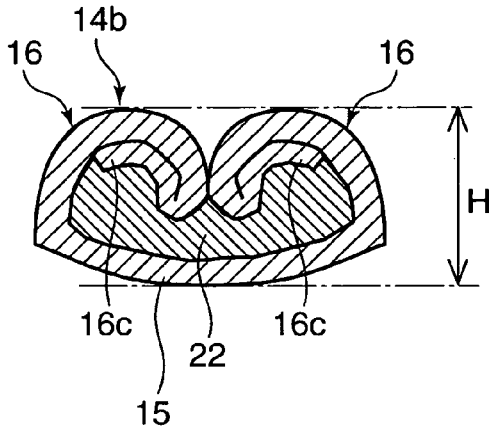
FIG. 22B is a sectional front view showing a part which is crimped to a tip end side part of the conductor.

In the crimp terminal 10 according to this embodiment, the dimension of the folded-back part (of the outside edge portion 16*c*) on the tip end side of the conductor 22, shown in FIG. 22B, is greater than the dimension of the folded-back part (i.e. the outside edge portion 16*c*) on the base side of the conductor 22, shown in FIG. 22A, further increasing continuously with closing to the tip end side of the conductor 22. This enables the degree of the compression of the conductor 22 to be increased continuously with closing to the tip end side.

Figure 23:
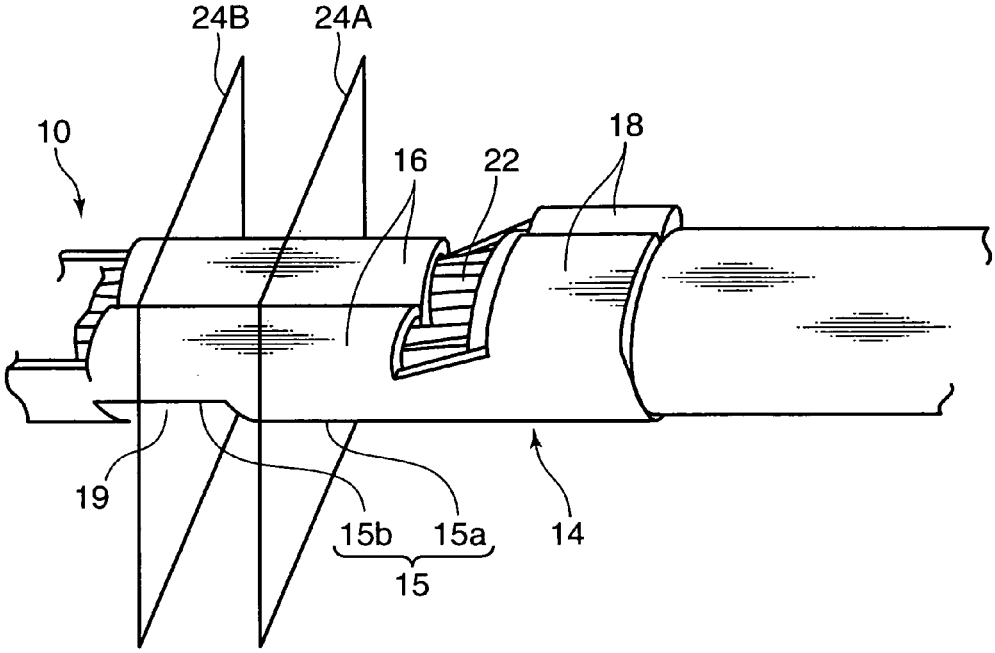
FIG. 23 is a perspective view of a crimped part of a terminal-provided wire according to a seventh embodiment of the present invention.
Figure 24A:
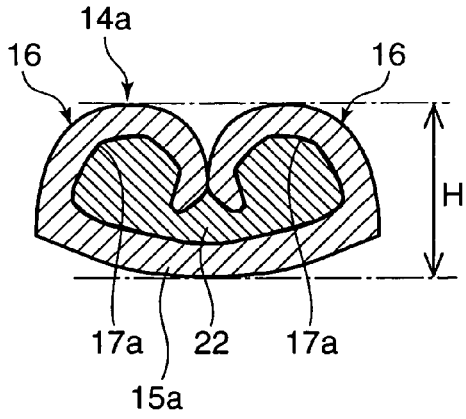
FIG. 24A is a view showing a cross-section 24A in FIG. 23.
Figure 24B:
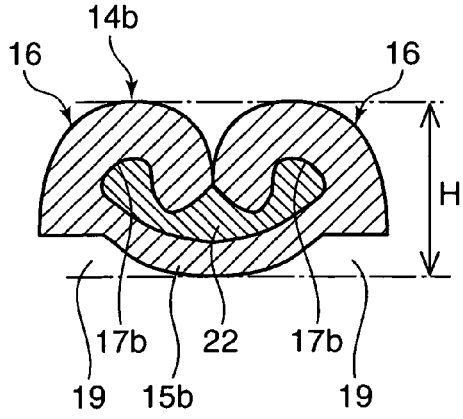
FIG. 24B is a view showing a cross-section 24B in FIG. 23.

The present invention permits other means for adjusting compression ratio to be provided to the wire crimp portion 14, in addition to setting the shape of the inner surface 17 of the conductor barrel 16. For example, in a terminal-provided wire shown in FIGS. 23 and 24 as a seventh embodiment, recessed portions 19 are formed in only a front side part (the part which is crimped to the tip end side part of the conductor 22) of the basal portion 15 of the crimp terminal 10 on respective right and left sides of the part 15*b*, thus making the inner surface of the front side part 15*b* corresponding to the tip end side part of the conductor 22 be protruded inwardly and radially of the conductor 22 beyond a rear side part 15*a* corresponding to the base side part of the conductor 22, by an dimension corresponding to that of the recess. The protrusion contributes the higher compression of the conductor 22. The recessed portion 19 may be formed together with forming of the crimp terminal.

Figure 25:
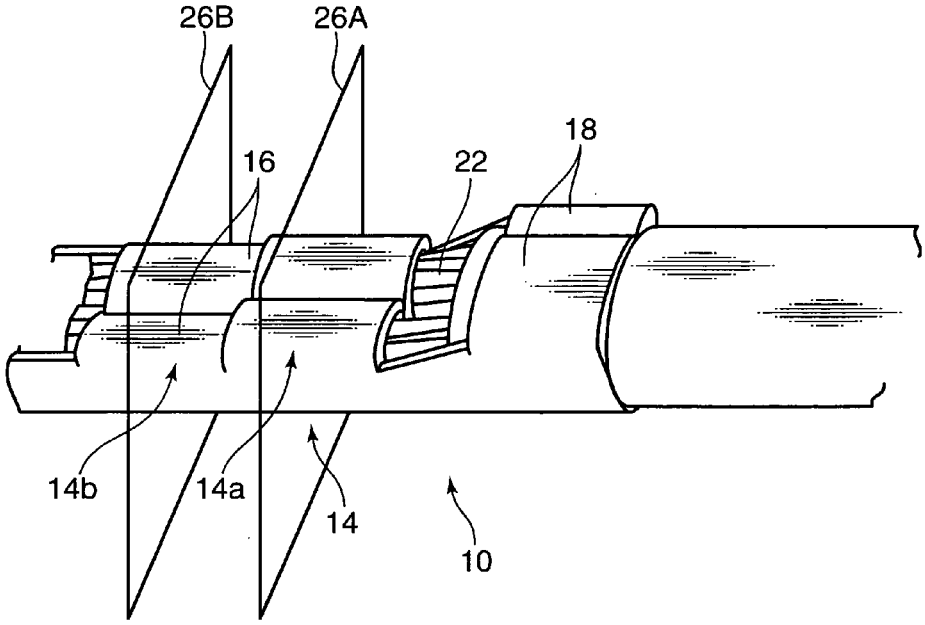
FIG. 25 is a perspective view of a crimped part of a terminal-provided wire according to an eighth embodiment of the present invention.
Figure 26A:
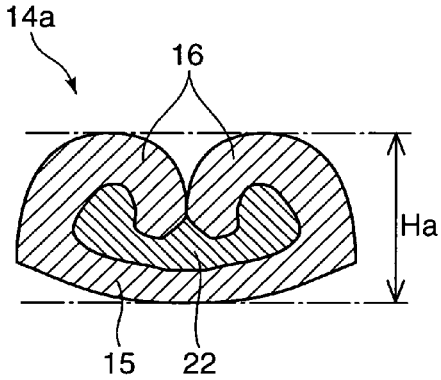
FIG. 26A is a view showing a cross-section 26A in FIG. 25.
Figure 26B:
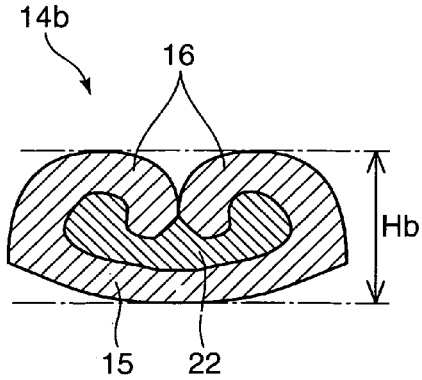
FIG. 26B is a view showing a cross-section 26B in FIG. 25.

Furthermore, as shown in FIG. 25 and FIGS. 26A and 26B as to an eighth embodiment, a difference in crimp height may be applied between the first crimp portion 14*a* on the base side of the conductor 22 and the second crimp portion 14*b* on the tip end side. More specifically, it is permitted to secure a large crimp height Ha in the first crimp portion 14*a* to thereby suppress compression which increases the compression ratio while setting a low crimp height Hb in the second crimp portion 14*b* to thereby perform a high compression which lowers the compression ratio. Also in this case, preferable is that the inner surface of the first crimp portion 14*a* be formed with first recessed portions continuously in the terminal width direction while the inner surface of the second crimp portion 14*b* be formed with a plurality of second recessed portions separated from each other in a single direction.

Figure 27:
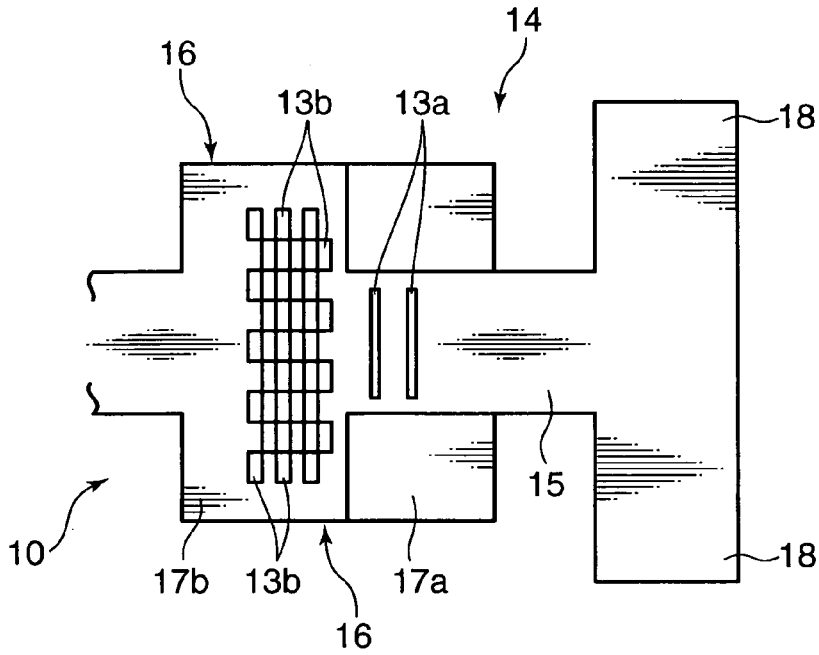
FIG. 27 is an envelopment of a crimp terminal according to a ninth embodiment of the present invention.
Figure 28:
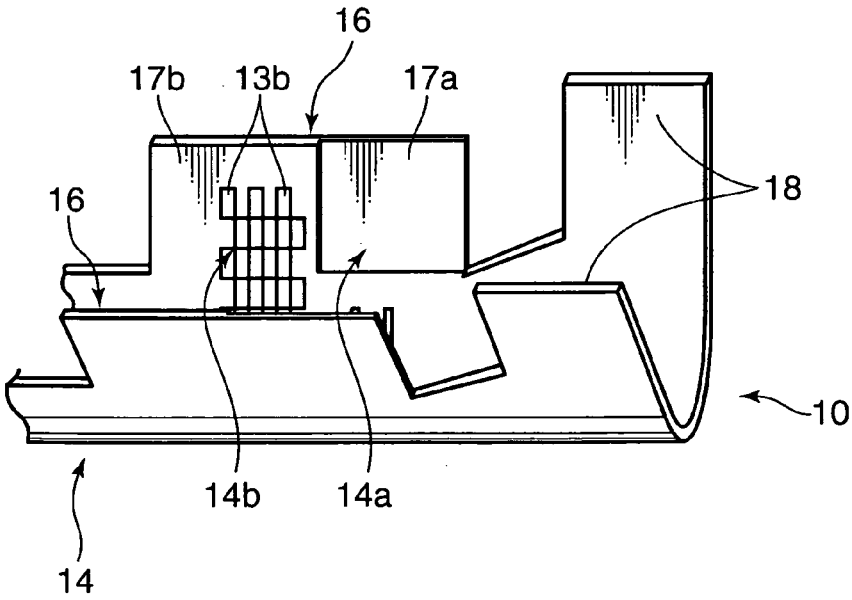
FIG. 28 is a perspective view showing a shape of the crimp terminal in FIG. 27 following forming.
Figure 29:
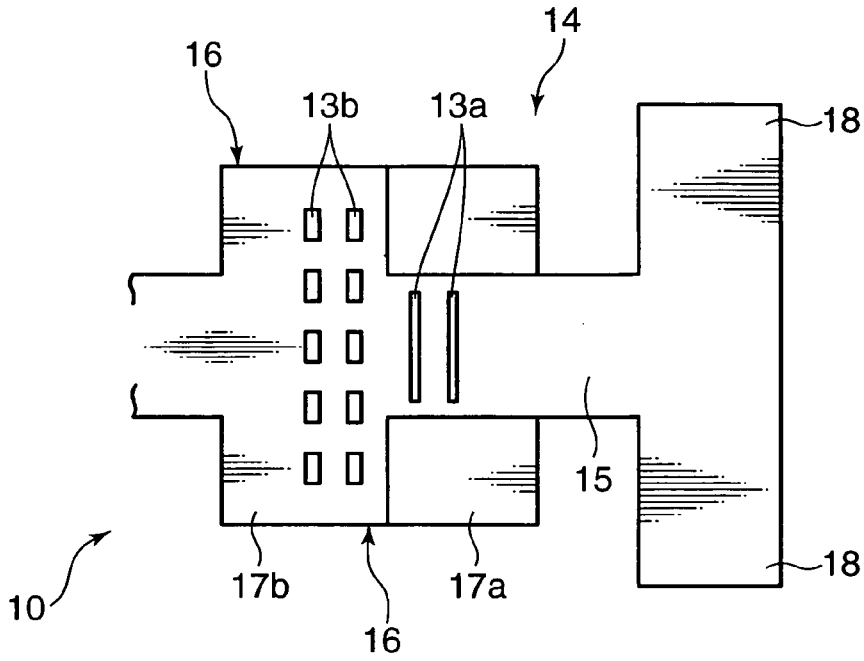
FIG. 29 is an envelopment of a crimp terminal according to a tenth embodiment of the present invention.
Figure 30:
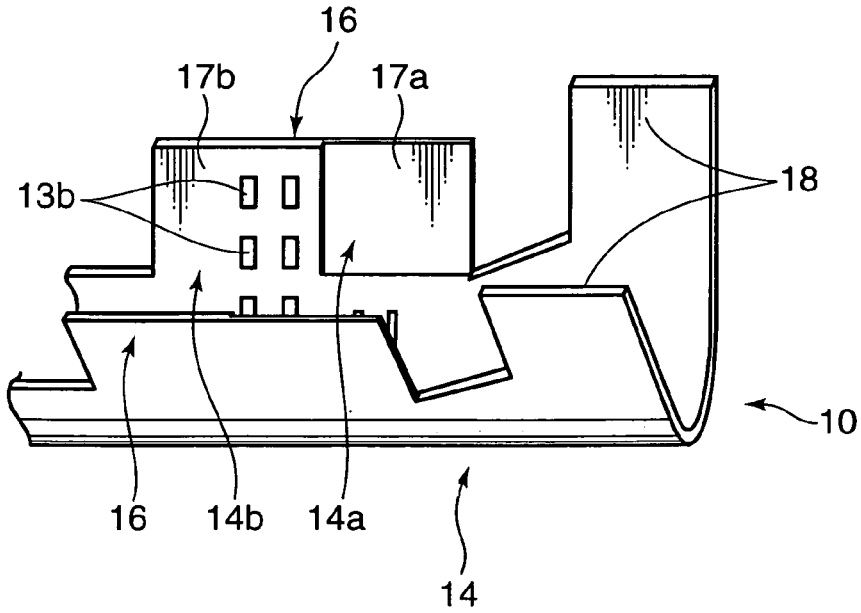
FIG. 30 is a perspective view showing a shape of the crimp terminal in FIG. 29 following forming.

The arrangement of the second recessed portions may be appropriately modified. For example, as shown in FIGS. 27 and 28 as to a ninth embodiment, there may be arranged a plurality of rows of the second recessed portions 13*b* closely to each other in the terminal axis direction, a plurality of the second recessed portions 13*b* arranged in the terminal width direction in each of the rows. In short, there may be formed a plurality of rectangular-shaped second recessed portions 13*b* in so-called a checkered pattern. Alternatively, as a tenth embodiment shown in FIGS. 29 and 30, there may be aligned a plurality of second recessed portions 13*b* in a matrix.

Figure 31:
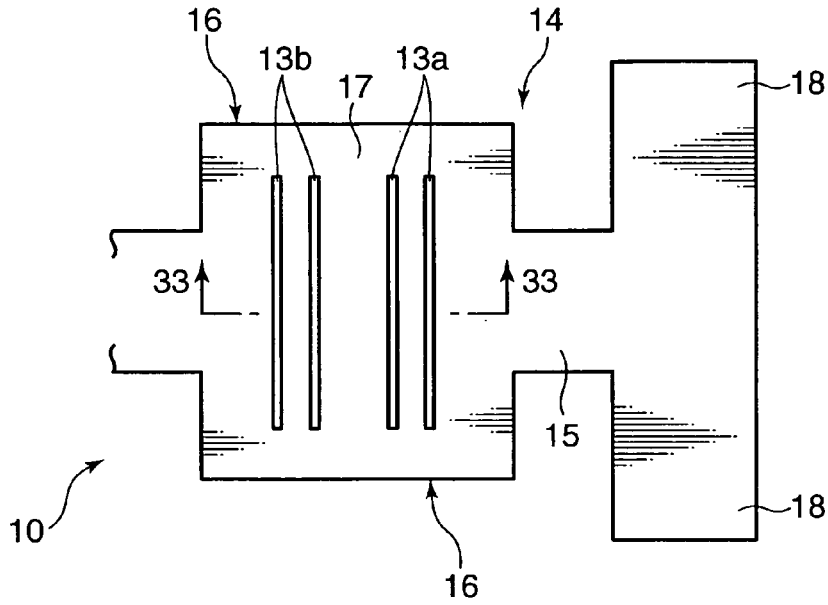
FIG. 31 is an envelopment of a crimp terminal according to an eleventh embodiment of the present invention.
Figure 32:
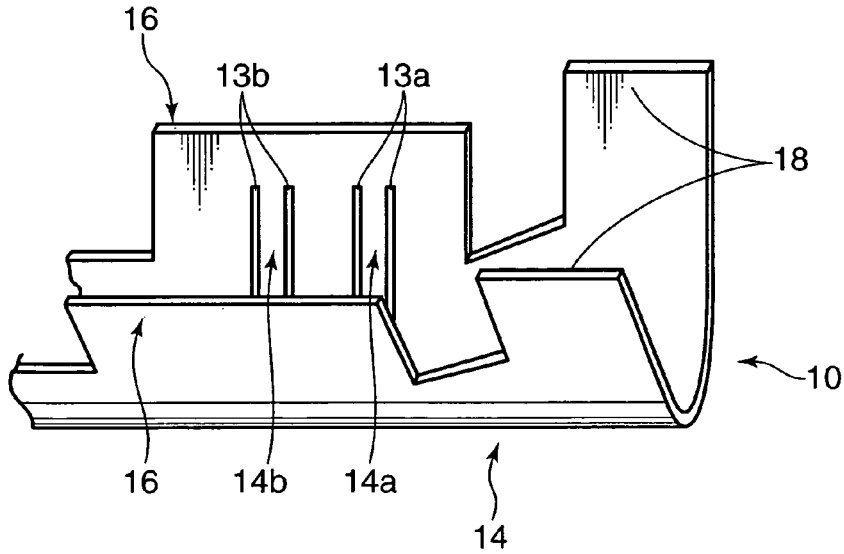
FIG. 32 is a perspective view showing a shape of the crimp terminal in FIG. 31 following forming.
Figure 33:
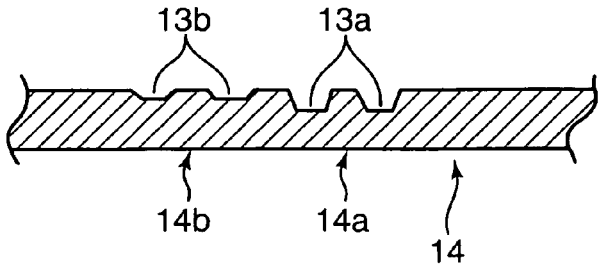
FIG. 33 is a sectional view taken along a 33-33 line in FIG. 31.

FIGS. 31 to 33 show an eleventh embodiment of the present invention. In this, the second recessed portions 13*b* formed in the second crimp portion 14*b* subjected to high-compression crimping are formed as elongated grooves continuously extending in the terminal width direction, similarly to the first recessed portions 13*a* provided in the first crimp portion 14*a* which is crimped with a relatively low compression. However, a depth of the second recessed portions 13*b* is set to be smaller than that of the first recessed portions 13*a*.

Also in this embodiment, a large thickness of the second crimp portion 14*b* is secured in the part forming the second recessed portions 13*b* because of the suppressed depth thereof, effectively suppressing a breakage due to the crimp of the second crimp portion 14*b* involving a high compression. Meanwhile, in the first crimp portion 14*a* which is subjected to a relatively low degree of compression, each the first recessed portion 13*a* is given a depth dimension enough to enable the first recessed portions 13*a* to exert a high cutting-in effect.

Furthermore, in the case of the first recessed portions 13*a* continuing in the terminal width direction and the second recessed portions 13*b* divided in the terminal width direction to be separated from each other in a single direction, as illustrated in the first embodiment and so on, setting the depth of the first recessed portions 13*a* greater than that of the second recessed portions 13*b* makes the effect by the present invention be more marked.

The specific depth dimensions of each of the recessed portions may be appropriately set on the basis of the thickness and material of the metal plate constituting the crimp terminal 10, the planar form and arrangement of the recessed portions, the compression ratios of the respective crimp portions, and so on. In general, for a thickness of the metal plate of 0.25 mm, the depth dimensions of the first recessed portion 13*a* and second recessed portion 13*b* are preferably set at approximately 0.05 mm and 0.03 mm, respectively.

Besides, in the case of including both of the first recessed portion 13*a* and second recessed portion 13*b* in pluralities respectively, the respective depth dimensions of the first recessed portions 13*a* may be non-equal to each other, and similarly, the respective depth dimensions of the second recessed portions 13*b* may be non-equal to each other. Moreover, the depth dimension of each recessed portion is permitted not to be constant over the entire region of the recessed portion, if a maximum depth of the first recessed portion is larger than that of the second recessed portion.

Figure 34:
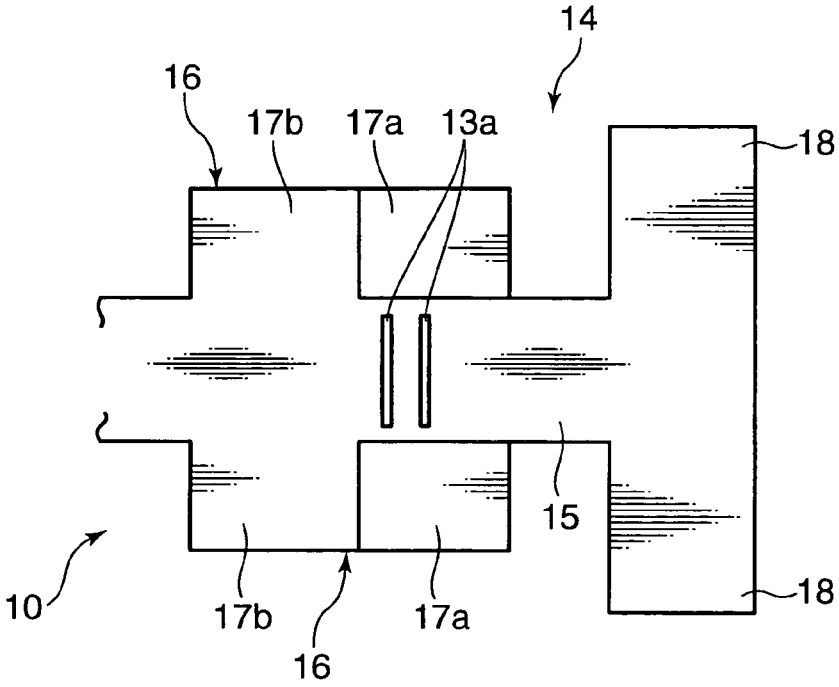
FIG. 34 is an envelopment of a crimp terminal according to a twelfth embodiment of the present invention.
Figure 35:
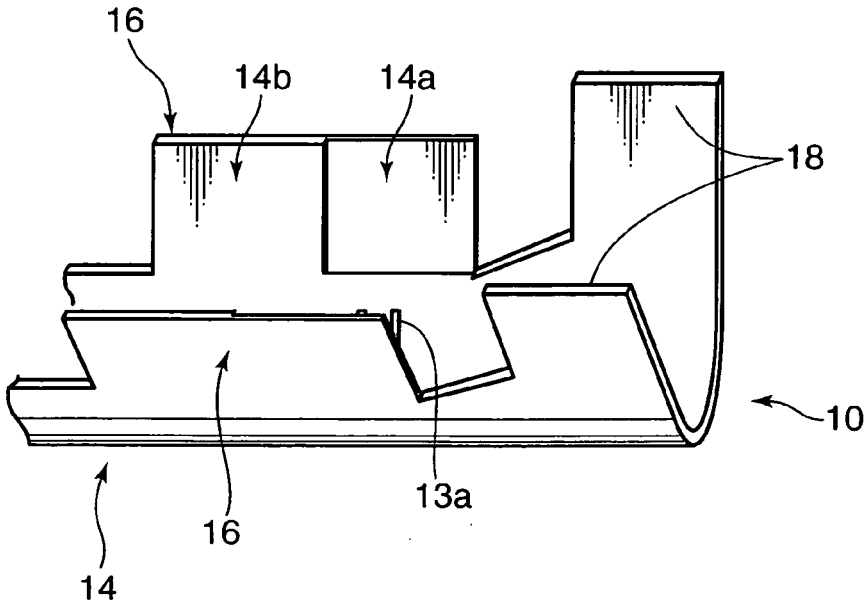
FIG. 35 is a perspective view showing a shape of the crimp terminal in FIG. 30 following forming.

FIGS. 34 and 35 show a twelfth embodiment of the present invention. This includes an omission of the second recessed portions 13*b* from the crimp terminal 10 according to the first embodiment . Specifically, in the wire crimp portion 14 of the crimp terminal 10, only the first crimp portion 14*a* which is crimped with a compression suppressed relatively to the second crimp portion 14*b* on the conductor tip end side recessed portions is given recesses (in this embodiment, the first recessed portions 13*a* continuous in the terminal width direction) on the inner surface thereof.

The crimp terminal 10, formed with recessed portions only in the first crimp portion 14*a* and no recessed portions in the inner surface of the second crimp portion 14*b*, can prevent the second crimp portion 14*b* from being broken due to the recessed portions, more reliably.

Figure 36:
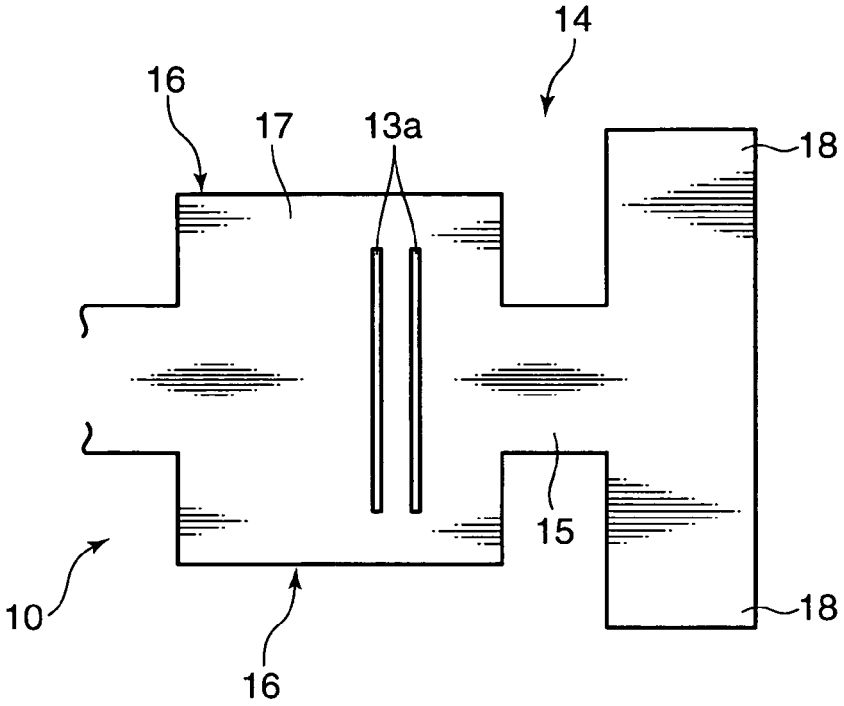
FIG. 36 is an envelopment of a crimp terminal according to a thirteenth embodiment of the present invention.
Figure 37:
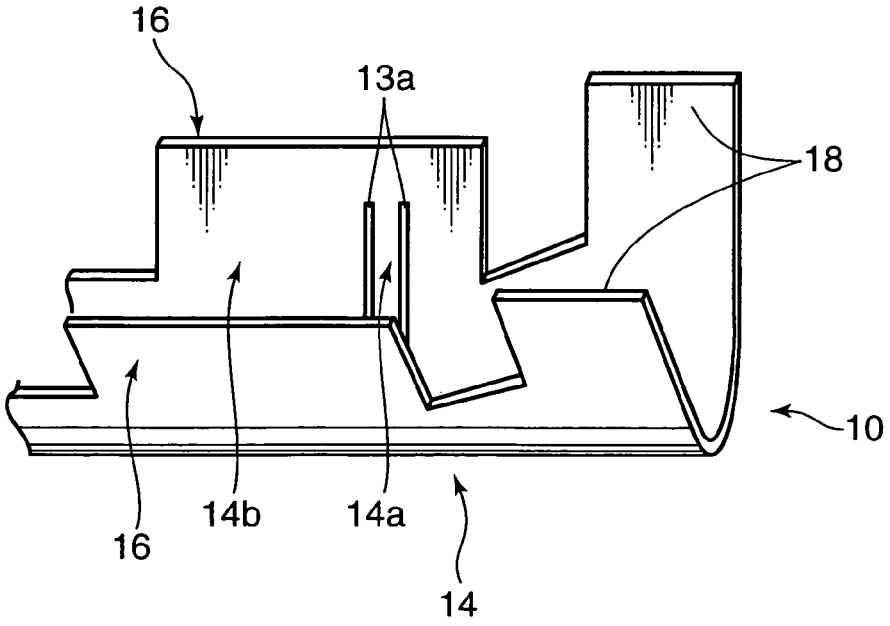
FIG. 37 is a perspective view showing a shape of the crimp terminal in FIG. 36 following forming.

Also in the case of thus omitting the recesses in the second crimp portion 14*b*, means for providing a difference in compression ratio between the first crimp portion 14*a* and second crimp portion 14*b* is not limited. For example, the means for providing the difference in compression ratio already shown in FIGS. 1 to 24 may be applied as is. Besides, as shown in FIGS. 36 and 37 according to a thirteenth embodiment, even in the crimp terminal 10 having an inner surface 17 of the wire crimp portion 14 which surface is uniform in the terminal axis direction, crimping the crimp portions 14*a* and 14*b* onto the conductor of the wire so as to make the crimp height of the first crimp portion 14*a* formed with the first recessed portions 13*a* be greater than that of the second crimp portion 14*b* formed with no recessed portions enables both of the cutting-in effect by the first recessed portions 13*a* in the first crimp portion 14*a* and the prevention of the breakage in the second crimp portion 14*b* to be established.

As described above, the present invention provides a technique of enabling high-compression crimping to be performed without involving a breakage of a crimp terminal while forming a recessed portion for promoting a wire crimp portion of the crimp terminal to cut into a conductor in the wire crimp portion. To achieve this object, the present invention provides a crimp terminal having an electric connection portion which is fitted to a counterpart terminal to thereby make electrical connection therewith and a wire crimp portion which is crimped to an end of a wire in which a conductor is exposed at the end. The wire crimp portion of the crimp terminal includes a first crimp portion which is crimped onto the conductor on the end of the wire from an outer side and a second crimp portion which is crimped onto the conductor from the outer side in a position closer to a tip end side of the conductor than the first crimp portion and with a higher degree of compression than the first crimp portion, further satisfying at least one of the following conditions A to C.

A. Recessed portions forming edges which cut into the conductor are provided to an inner surface of the first crimp portion and an inner surface of the second crimp portion respectively, wherein the recessed portion provided in the first crimp portion is formed continuously in a direction orthogonal to an axial direction of the terminal while the recessed portion provided in the second crimp portion is divided into a plurality of recessed portions in a division direction orthogonal to the axial direction of the terminal and the divided recessed portions are separated from each other in the division direction.

B. Recessed portions forming edges which cut into the conductor are provided to an inner surface of the first crimp portion and an inner surface of the second crimp portion respectively, wherein a maximum depth of the recessed portion provided in the second crimp portion is smaller than a maximum depth of the recessed portion provided in the first crimp portion.

C. A recessed portion forming an edge which cuts into the conductor is provided only on an inner surface of the first crimp portion of the first and second crimp portions.

The crimp terminal satisfying at least one of the conditions A to C can be crimped onto the conductor with a high degree of compression without involving a breakage of the crimp terminal while formed with the recessed portion for reducing contact resistance between the conductor and the wire crimp portion of the crimp terminal. Specifically, in the first crimp portion of the wire crimp portion, the edges of the recessed portion formed in the second first crimp portion cut into the conductor at the second crimp portion, thereby increasing a force by which the conductor is held and lowering contact resistance between the first crimp portion and the conductor while suppressing compression of the conductor by the first crimp portion. Moreover, suppressing compression in the first crimp portion prevents the terminal of the first crimp portion from being broken in a part forming the recessed portion.

On the other hand, the recessed portion formed in the second crimp portion is divided in the division direction orthogonal to the terminal axis direction, or the recessed portion formed in the second crimp portion has a smaller maximum depth than that of the recessed portion formed in the first crimp portion, or no recessed portion is formed in the second crimp portion; this enables the second crimp portion to be crimped onto the conductor with a high degree of compression while suppressing breakage due to the recessed portion. In other words, according to the present invention, the second crimp portion, though having a lower cutting-in effect by the recessed portion than that of the first crimp portion, can suppress or prevent terminal breakage at the recessed portion during high-compression crimping, while the first crimp portion can exert a sufficient cutting-in effect by the recessed portion thereof.

In case that the recessed portion provided in the second crimp portion is divided into a plurality of recessed portions in the division direction orthogonal to the axial direction of the terminal and the divided recessed portions are separated from each other in the axial direction as in the. condition A, the effect of cutting into the conductor by the recessed portion is not made in the regions where the recessed portion is absence, but can be made uniform in the direction orthogonal to the terminal axis direction by such an arrangement that the divided recessed portions are provided in each of a plurality of rows arranged in the terminal axis direction and the positions of the recessed portions in each row are offset in a direction along the low from the positions of the recessed portions provided in an adjacent row.

To provide a difference between the compression ratio of the first crimp portion and the compression ratio of the second crimp portion, there may be provided a difference in the respective crimp heights of the two crimp portions, for example. However, a large difference in crimp height causes a large step in the wire crimp portion, which is disadvantageous in terms of strength, and increases manufacturing difficulty. On contrary, when at least a part of an inner surface of a part of the wire crimp portion corresponding to the second crimp portion projects inwardly beyond an inner surface in a part corresponding to the first crimp portion and has such a shape that a tip end side part of the conductor is subjected to a higher degree of compression than a base side part of the conductor during the bending, a difference in compression ratio can be provided between the first crimp portion and second crimp portion without largely varying the crimp height in the axial direction of the crimp terminal. This allows both of securing mechanical strength in the terminal-provided wire and lowering the contact resistance between the wire and the crimp terminal to be established.

Specifically, the inner surface of the part corresponding to the second crimp portion, projecting inwardly beyond the inner surface of the part corresponding to the first crimp portion, is crimped onto the tip end side part of the conductor with a greater pressure, thereby lowering the contact resistance with the conductor. Meanwhile, the inner surface of the part corresponding to the second crimp portion can secure its mechanical strength by suppression of compression of the base side part of the conductor and a function for promoting the cutting-in effect of the recessed portion formed on the inner surface.

The present invention further provides a terminal-provided wire including a wire having an end in which a conductor is exposed and a crimp terminal which is crimped to the end, wherein the wire crimp portion of the crimp terminal is crimped onto the conductor on the end of the wire from an outer side, and the second crimp portion of the wire crimp portion is crimped onto the conductor with a higher degree of compression than the first crimp portion formed with the recessed portion.

In this terminal-provided wire, the suppression of the compression of the first crimp portion of the wire crimp portion and the recessed portion formed in the first crimp portion maintains the conductor holding force by the wire crimp portion at a high level, while the crimp of the second crimp portion onto the tip end side part of the conductor with a high degree of compression lowers the contact resistance between the two. Hence, the present invention is particularly effective for requirement of high-compression crimping, that is, crimping at a low compression ratio. For example, a wire having a conductor formed of aluminum or aluminum alloy on whose surface an oxide film tends to be formed may require a compression ratio of, for example, approximately 40% to 70% to break through the oxide film formed thereon to reduce the contact resistance: the present invention is extremely effective for this case.

The present invention further provides a method of manufacturing a terminal-provided wire comprising a wire in which a conductor is exposed on an end thereof and a crimp terminal which is crimped to the end, the method including a terminal forming step of forming the crimp terminal from a metal plate, and a crimping step of crimping the wire crimp portion of the crimp terminal to the conductor on the end of the wire from the outer side and crimping the second crimp portion of the wire crimp portion onto the conductor with a higher degree of compression than the first crimp portion formed with the recessed portion.

The invention claimed is:

1. A crimp terminal having an electric connection portion which is fitted to a counterpart terminal to thereby make an electrical connection therewith and a wire crimp portion which is crimped to an end of a wire in which a conductor is exposed at the end, wherein the wire crimp portion comprises a first crimp portion which is crimped to the conductor on the end of the wire from an outer side, and a second crimp portion which is crimped to the conductor from the outer side in a position closer to a tip end side of the conductor than the first crimp portion and with a higher degree of compression than the first crimp portion, and an inner surface of the first crimp portion and an inner surface of the second crimp portion are provided with recessed portions forming edges that cut into the conductor respectively, the recessed portion provided in the first crimp portion being continuous in an direction orthogonal to an axial direction of the terminal while the recessed portion provided in the second crimp portion being divided into a plurality of recessed portions in a division direction orthogonal to the axial direction of the terminal, the divided recessed portions being separated from each other in the axial direction.

2. The crimp terminal according to claim 1, wherein the divided recessed portions provided in the second crimp portion are arranged in a plurality of rows arranged in the terminal axis direction, positions of the recessed portions provided in each row being offset in a direction along the low from positions of the recessed portions provided in an adjacent row.

3. A crimp terminal having an electric connection portion which is fitted to a counterpart terminal to thereby make an electrical connection therewith, and a wire crimp portion which is crimped to an end of a wire in which a conductor is exposed at the end, wherein the wire crimp portion comprises a first crimp portion which is crimped to the conductor on the end of the wire from an outer side, and a second crimp portion which is crimped to the conductor from the outer side in a position closer to a tip end side of the conductor than the first crimp portion and with a higher degree of compression than the first crimp portion, and an inner surface of the first crimp portion and an inner surface of the second crimp portion are provided with recessed portions forming edges that cut into the conductor respectively, a maximum depth of the recessed portion provided in the second crimp portion being smaller than a maximum depth of the recessed portion provided in the first crimp portion.

4. A crimp terminal having an electric connection portion which is fitted to a counterpart terminal to thereby make an electrical connection therewith, and a wire crimp portion which is crimped to an end of a wire in which a conductor is exposed at the end, wherein the wire crimp portion comprises a first crimp portion which is crimped to the conductor on the end of the wire from an outer side, and a second crimp portion which is crimped to the conductor from the outer side in a position closer to a tip end side of the conductor than the first crimp portion and with a higher degree of compression than the first crimp portion, and a recessed portion forming an edge that cuts into the conductor is provided only in an inner surface of the first crimp portion of the first and second crimp portions.

5. The crimp terminal according to claim 1, wherein the wire crimp portion includes a basal portion extending in an axial direction from the electric connection portion, and a conductor barrel which is formed of a metal plate extending from the basal portion across the axial direction and is subjected to bending so as to hold the exposed conductor on the end of the wire, and the conductor barrel has an inner surface in a shape that a second part of the inner surface corresponding to the second crimp portion projects inwardly beyond a first part of the inner surface corresponding to the first crimp portion to compress a tip end side part of the conductor by a higher degree than a base side part of the conductor by the bending.

6. A terminal-provided wire comprising a wire having an end in which a conductor is exposed and the crimp terminal according to claim 1, which is crimped to the end, wherein the wire crimp portion of the crimp terminal is crimped onto the conductor in the end of the wire from an outer side, and the second crimp portion of the wire crimp portion is crimped onto the conductor with a higher degree of compression than the first crimp portion thereof.

7. The terminal-provided wire according to claim 6, wherein the conductor of the wire is formed of aluminum or aluminum alloy.

8. A method of manufacturing a terminal-provided wire comprising a wire having an end in which a conductor is exposed and a crimp terminal which is crimped to the end, the method including:

a terminal forming step of forming the crimp terminal according to claim 1 from a metal plate; and a crimping step of crimping the wire crimp portion of the crimp terminal onto the conductor in the end of the wire from the outer side while crimping the second crimp portion of the wire crimp portion onto the conductor with a higher degree of compression than the first crimp portion formed with the recessed portion.

9. The method of manufacturing a terminal-provided wire according to claim 8, wherein the conductor is constituted by aluminum or aluminum alloy.

10. The crimp terminal according to claim 3, wherein the wire crimp portion includes a basal portion extending in an axial direction from the electric connection portion, and a conductor barrel which is formed of a metal plate extending from the basal portion across the axial direction and is subjected to bending so as to hold the exposed conductor on the end of the wire, and the conductor barrel has an inner surface in a shape that a second part of the inner surface corresponding to the second crimp portion projects inwardly beyond a first part of the inner surface corresponding to the first crimp portion to compress a tip end side part of the conductor by a higher degree than a base side part of the conductor by the bending.

11. A terminal-provided wire comprising a wire having an end in which a conductor is exposed and the crimp terminal according to claim 3, which is crimped to the end, wherein the wire crimp portion of the crimp terminal is crimped onto the conductor in the end of the wire from an outer side, and the second crimp portion of the wire crimp portion is crimped onto the conductor with a higher degree of compression than the first crimp portion thereof.

12. The terminal-provided wire according to claim 11, wherein the conductor of the wire is formed of aluminum or aluminum alloy.

13. A method of manufacturing a terminal-provided wire comprising a wire having an end in which a conductor is exposed and a crimp terminal which is crimped to the end, the method including:

a terminal forming step of forming the crimp terminal according to claim 3 from a metal plate; and a crimping step of crimping the wire crimp portion of the crimp terminal onto the conductor in the end of the wire from the outer side while crimping the second crimp portion of the wire crimp portion onto the conductor with a higher degree of compression than the first crimp portion formed with the recessed portion.

14. The method of manufacturing a terminal-provided wire according to claim 13, wherein the conductor is constituted by aluminum or aluminum alloy.

15. The crimp terminal according to claim 4, wherein the wire crimp portion includes a basal portion extending in an axial direction from the electric connection portion, and a conductor barrel which is formed of a metal plate extending from the basal portion across the axial direction and is subjected to bending so as to hold the exposed conductor on the end of the wire, and the conductor barrel has an inner surface in a shape that a second part of the inner surface corresponding to the second crimp portion projects inwardly beyond a first part of the inner surface corresponding to the first crimp portion to compress a tip end side part of the conductor by a higher degree than a base side part of the conductor by the bending.

16. A terminal-provided wire comprising a wire having an end in which a conductor is exposed and the crimp terminal according to claim 4, which is crimped to the end, wherein the wire crimp portion of the crimp terminal is crimped onto the conductor in the end of the wire from an outer side, and the second crimp portion of the wire crimp portion is crimped onto the conductor with a higher degree of compression than the first crimp portion thereof.

17. The terminal-provided wire according to claim 16, wherein the conductor of the wire is formed of aluminum or aluminum alloy.

18. A method of manufacturing a terminal-provided wire comprising a wire having an end in which a conductor is exposed and a crimp terminal which is crimped to the end, the method including:

a terminal forming step of forming the crimp terminal according to claim 4 from a metal plate; and a crimping step of crimping the wire crimp portion of the crimp terminal onto the conductor in the end of the wire from the outer side while crimping the second crimp portion of the wire crimp portion onto the conductor with a higher degree of compression than the first crimp portion formed with the recessed portion.

19. The method of manufacturing a terminal-provided wire according to claim 18, wherein the conductor is constituted by aluminum or aluminum alloy.

* * * * *